US005803787A

United States Patent [19]

Kulchyski

[11] Patent Number: 5,803,787

[45] Date of Patent: Sep. 8, 1998

[54] APPARATUS AND METHOD FOR SECURING A WING TO A TORSO OF A DOLL

[76] Inventor: Emily Kulchyski, 73 N. Park Pl., New Orleans, La. 70124

[21] Appl. No.: 815,735

[22] Filed: Mar. 12, 1997

Related U.S. Application Data

[63] Continuation-in-part of Ser. No. 300,920, Sep. 6, 1994, abandoned.

[51] Int. Cl.[6] ..... A63H 3/36

[52] U.S. Cl. ..... 446/268; 446/97

[58] Field of Search ..... 446/97, 98, 268, 446/330, 113, 121, 365; 24/297, 563, 453

[56] References Cited

U.S. PATENT DOCUMENTS

| | | | |
|---|---|---|---|
| 459,683 | 9/1891 | Fachs | 446/268 |
| 1,372,329 | 3/1921 | Anderson | 24/563 |
| 2,203,128 | 6/1940 | Cairo | 446/98 |
| 2,312,286 | 2/1943 | Reich | 446/268 |
| 2,725,654 | 12/1955 | Kosihar | 446/268 |
| 2,994,156 | 8/1961 | Stuner et al. | 446/268 |
| 3,577,670 | 5/1971 | Gutierrez | 446/330 |
| 3,705,442 | 12/1972 | Sygnator | 24/297 |
| 3,792,858 | 2/1974 | Cross, Jr. et al. | 446/121 |
| 4,571,206 | 2/1986 | Mayer et al. | 446/330 |
| 4,575,349 | 3/1986 | Piazza et al. | 446/330 |
| 4,576,535 | 3/1986 | Howering | 24/453 |
| 4,581,793 | 4/1986 | Micklitz | 24/297 |
| 4,601,478 | 7/1986 | Robertson et al. | 446/365 X |
| 4,677,714 | 7/1987 | Wright | 24/297 |
| 4,718,877 | 1/1988 | Girsch et al. | 446/330 |
| 4,723,931 | 2/1988 | Allen et al. | 446/268 |
| 4,729,748 | 3/1988 | Van Ruymbeke | 446/121 |
| 4,867,729 | 9/1989 | Weinman et al. | 446/330 |
| 4,966,482 | 10/1990 | Fujimoto | 24/453 |
| 5,022,886 | 6/1991 | Jenkins | 446/268 |
| 5,084,944 | 2/1992 | Hiliman | 24/453 |
| 5,172,863 | 12/1992 | Melone et al. | 446/415 |
| 5,277,645 | 1/1994 | Kelley et al. | 446/268 |

*Primary Examiner*—Robert A. Hafer
*Assistant Examiner*—Jeffrey D. Carlson
*Attorney, Agent, or Firm*—John W. Carpenter

[57] ABSTRACT

A guardian angel doll, a wing member, and a method for removably securing a wing to a doll by providing a doll body having a structure defining a back and at least one torso cavity. The back has an external opening with an opening length and an opening width, and an internal cavity communicating with the external opening. The method additionally includes providing a wing having a wing structure, a wing base secured to the wing structure and having a base length that is less than the opening length and a base width that is less than the width opening of the external opening. The wing also has a wing lug secured to the wing base. The wing lug has a lug length that is greater than the length of the opening length and a lug width that is less than the width opening; and the wing lug further has a first bevelled lug end and a second bevelled lug end. The method further additionally includes inserting the first bevelled lug end through the external opening and into the internal cavity and subsequently inserting the second bevelled lug end through the external opening and into the internal cavity.

10 Claims, 7 Drawing Sheets

APPARATUS AND METHOD FOR SECURING A WING TO A TORSO OF A DOLL

This is a continuation-in-part application of application having U.S. Ser. No. 08/300,920, filed Sep. 6, 1994 now abandoned. Benefit of all common subject matter with respect to the Sep. 6, 1994 filing date of application U.S. Ser. No. 08/300,920 is claimed.

FIELD OF THE INVENTION

This invention is related to dolls and the like. More specifically, the present invention provides for an apparatus and a method for removably securing a wing to a Guardian Angel Doll.

DESCRIPTION OF THE PRIOR ART

A patentability investigation was conducted and the following U.S. Patents were discovered:

U.S. Pat. No. Des. 77,860 to M. Rowell

U.S. Pat. No. Des. 95,094 to J. B. Ullman

U.S. Pat. No. Des. 104,465 to D. J. McNamara

U.S. Pat. No. Des. 134,187 to N. Falardo

U.S. Pat. No. Des. 136,531 to N. Falardo

U.S. Pat. No. Des. 136,532 to N. Falardo

U.S. Pat. No. Des. 219,924 to Ramona McD. Trush

U.S. Pat. No. Des. 219,925 to Ramona McD. Trush

U.S. Pat. No. Des. 224,422 to Sondra J. Sicherman

U.S. Pat. No. Des. 248,843 to Campbell

U.S. Pat. No. Des. 311,230 to Sharyl J. Hutchinson

U.S. Pat. No. Des. 312,676 to Lindsay

U.S. Pat. No. 317,341 to Cardillo

U.S. Pat. No. Des. 317,342 to Warchollik

U.S. Pat. No. 3,595,727 to Dorothy K. Allen

U.S. Pat. No. 4,979,921 to Cardillo

None of the foregoing U.S. Patents teach or suggest the particular apparatus and method of the present invention. The foregoing U.S. Patents are incorporated herein by reference as if repeated verbatim immediately hereinafter.

SUMMARY OF THE INVENTION

The present invention accomplishes its desired objects by providing a guardian angel doll comprising a doll body having a structure defining a back and at least one torso cavity. The back has a recess with a recess bottom including at least one opening communicating with the torso cavity. A wing support member is disposed in the recess and includes at least one channel and at least one dowel passing through the opening and extending into the torso cavity. The dowel has a dowel aperture for receiving a pin member. At least one wing member is provided with a wing structure, a wing base secured to the wing structure and a wing lug secured to the wing base and removably lodged within the channel for removably mounting the wing member to the doll. The guardian angel doll further comprises the channel as being generally trapezoidal in vertical cross section and being defined by a channel opening, a channel end, and a pair of sloping channel sides terminating in the channel end. The wing lug is generally trapezoidal in vertical cross section. The guardian angel doll additionally comprises a pin which slidably passes through the dowel aperture.

The present invention accomplishes its desired objects by broadly providing a method for removably securing the wing to a torso of a Guardian Angel Doll. The method comprises the steps of: (a) providing a doll body having a structure defining a back and at least one torso cavity, said back having an external opening with an opening length and an opening width, and an internal cavity communicating with the external opening; (b) providing a wing having a wing structure, a wing base secured to said wing structure and having a base length that is less than the opening length and a base width that is less than the width opening of the external opening in step (a), and a wing lug secured to said wing base, said wing lug having a lug length that is greater than the length of the opening length and a lug width that is less than the width opening and said wing lug further having a first bevelled lug end and a second bevelled lug end; and (c) inserting the first bevelled lug end through said external opening and into said internal cavity and subsequently inserting said second bevelled lug end through said external opening and into said internal cavity. The method additionally comprises diminishing, prior to subsequently inserting the second bevelled lug end through the external opening, a straight line distance between the first bevelled lug end and the second bevelled lug end. The method further additionally comprises grasping, prior to subsequently inserting the second bevelled lug end through said external opening, the second bevelled lug end; and bending the wing lug such that a straight line distance between the first bevelled lug end and the second bevelled lug end is diminished; and releasing the second bevelled lug end. The method yet further additionally comprises forming the wing lug with a pair of lug recesses.

The present invention also accomplishes its desired objects by further broadly providing a guardian angel doll comprising a doll body having a structure defining a back and at least one torso cavity. The back has an external opening with an opening length and an opening width, and an internal back cavity communicating with the external opening. At least one wing member is removably secured to the back. The wing member has a wing structure, a wing base secured to the wing structure with a base length that is less than the opening length and a base width that is less than the width opening of the external opening. A wing lug is secured to the wing base. The wing lug has a lug length that is greater than the length of the opening length and a lug width that is less than the width opening. The wing lug further has a first bevelled lug end and a second bevelled lug end and a pair of lug recesses.

The present invention further also accomplishes its desired objects by further broadly providing a wing for a guardian angel doll comprising a wing structure, a wing base secured to the wing structure and having a base length and a base width; and a wing lug secured to the wing base. The wing lug has a first bevelled lug end and a second bevelled lug end and a pair of recesses.

It is therefore an object of the present invention to provide a guardian angel doll and a method for removably securing a wing to a guardian angel doll.

These, together with the various ancillary objects and features which will become apparent to those skilled in the art as the following description proceeds, are attained by this novel apparatus and method, a preferred embodiment being shown with reference to the accompanying drawings, by way of example only, wherein:

DETAILED DESCRIPTION OF THE INVENTION

Figure 1:
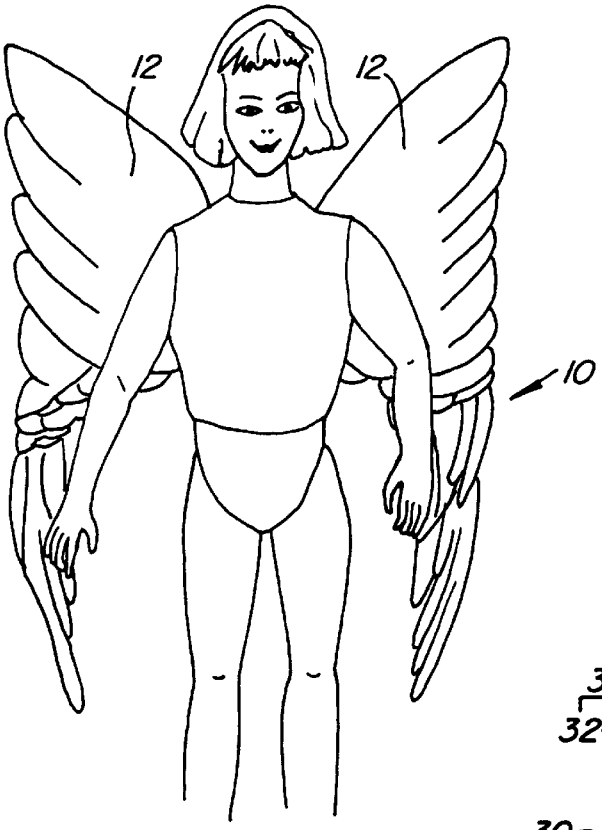
FIG. 1 is a front elevational view of one embodiment of a guardian angel doll having a pair of wings removably secured to the back thereof.

Referring in detail now to the drawings wherein similar parts of the invention are identified by like reference numerals, there is seen a doll (preferably a guardian angel doll), generally illustrated as 10, having a pair of removably, detachably wings, generally illustrated as 12—12, secured to the doll 10. As will be set forth in detail below, the wings 12—12 have various preferred embodiments.

Figure 16:
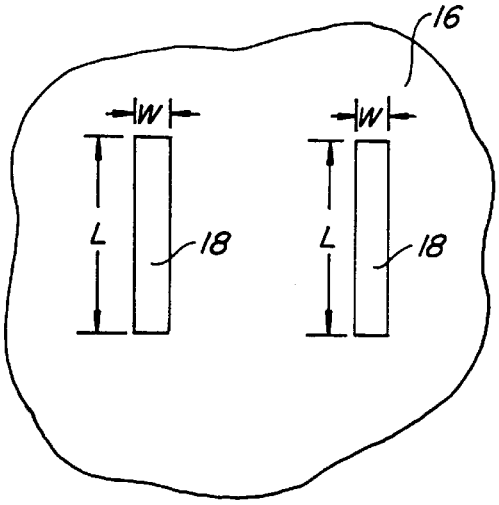
FIG. 16 is a partial front elevational view of the back of the doll illustrating the pair of longitudinal slots.

The doll 10 has a torso 14 which is preferably generally hollow with a cavity 15, which may be the entire insides of the doll 10 including an associated back 16. The torso 14 has the back 16 formed with a pair of longitudinal slots or openings 18—18 wherethrough the wings 12—12 removably lodge for forming a guardian angel doll. Each slot 18 (see FIG. 16) has a slot width W and a slot length L.

Figure 3A:
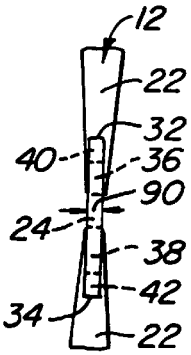
FIG. 3A is an elevational view of the wing member taken in direction of the arrows and along the plane of line 3A—3A in FIG. 3.
Figure 3:
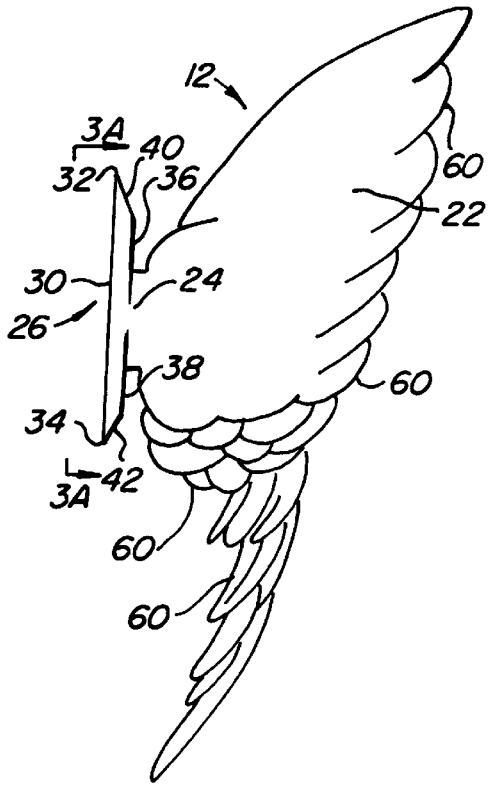
FIG. 3 is a side elevational view of one embodiment of the wing member removed from the torso of the guardian angel doll.
Figure 2:
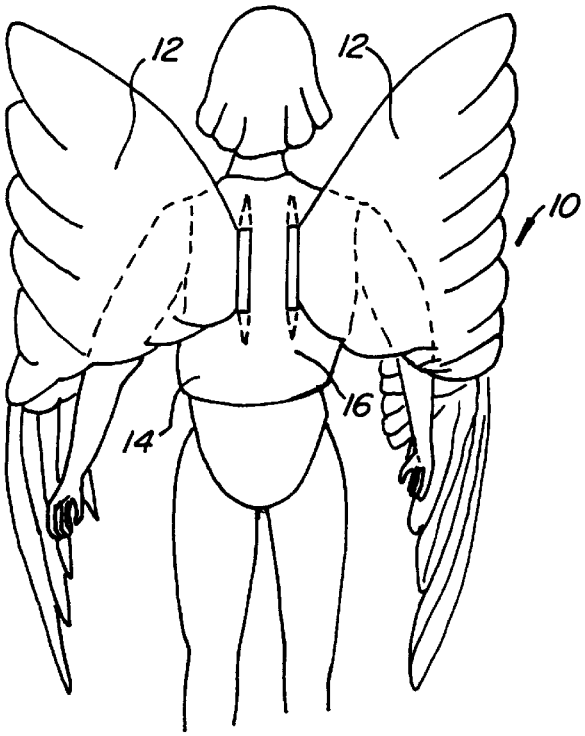
FIG. 2 is a rear elevational view of the embodiment of the guardian angel doll of FIG. 1.
Figure 4:
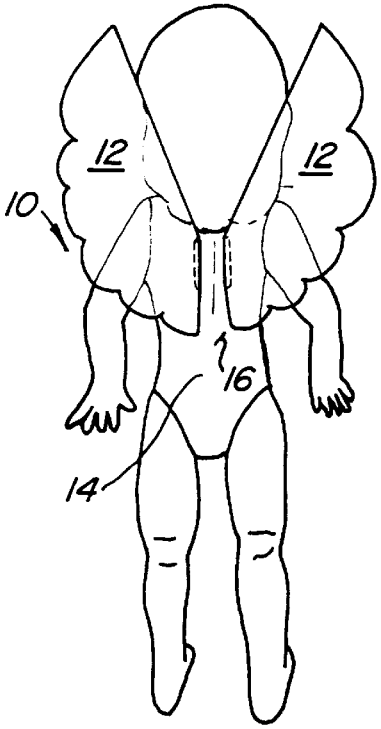
FIG. 4 is a rear elevational view of another embodiment of the guardian angel doll having a pair of wings removably attached thereto.
Figure 5:
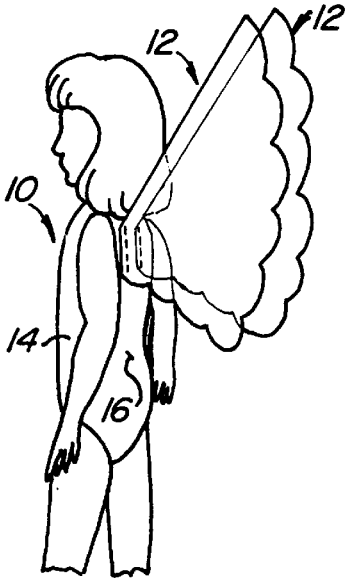
FIG. 5 is a partial perspective view of the guardian angel doll of FIG. 4.
Figure 6:
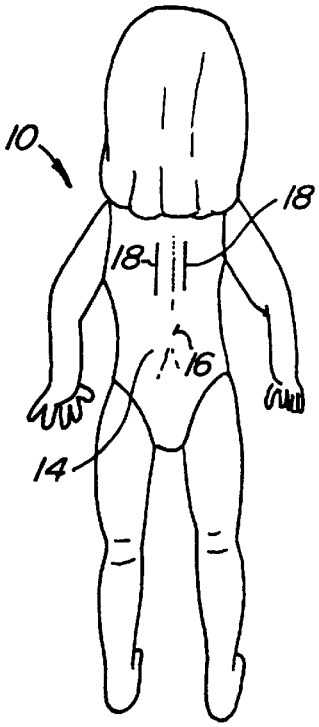
FIG. 6 is a rear elevational view of the guardian angel doll of FIG. 4 with the pair of wings removed therefrom.
Figure 7:
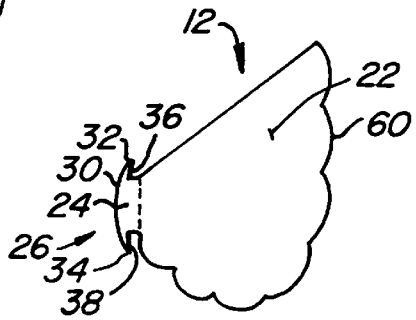
FIG. 7 is a side elevational view of one embodiment of a wing member.
Figure 8:
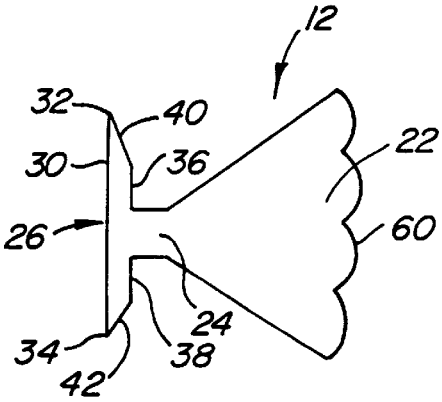
FIG. 8 is a side elevational view of another embodiment of a wing member.
Figure 9:
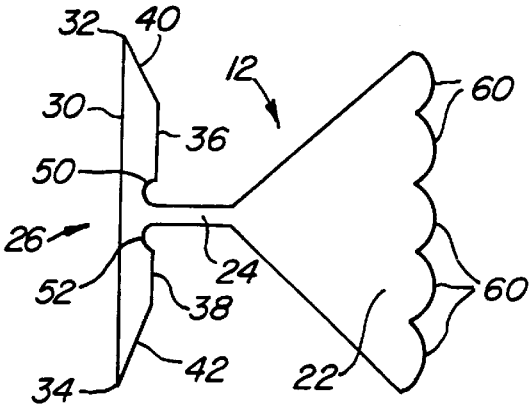
FIG. 9 is a side elevational view of yet another embodiment of a wing member.
Figure 10:
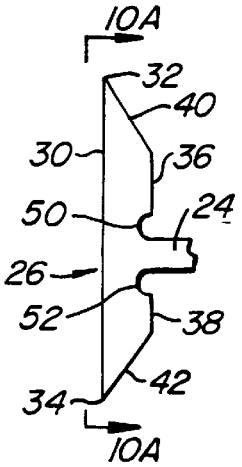
FIG. 10 is a partial side elevational view of part of the wing member of FIG. 9.
Figure 10A:
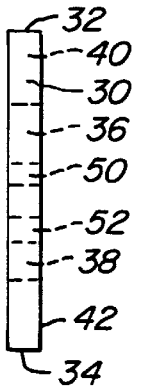
FIG. 10A is an elevational view of the wing member taken in direction of the arrows and along the plane of line 10A—10A in FIG. 10.
Figure 11:
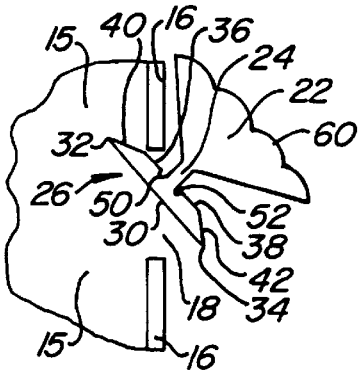
FIG. 11 is a partial side elevational view of one embodiment of the wing member initially having an end of its associated wing lug being inserted into one of the openings in the back of the torso of a guardian angel doll.
Figure 12:
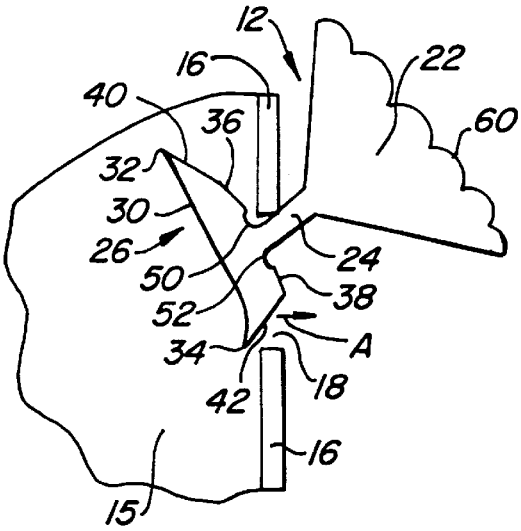
FIG. 12 is a partial side elevational view illustrating diminishing the straight line distance between two extreme points of the wing lug as a subsequent step to the step of FIG. 11 for inserting the wing lug through one of the openings in the back of the torso of a guardian angel doll for removably securing the wing member thereto.
Figure 13:
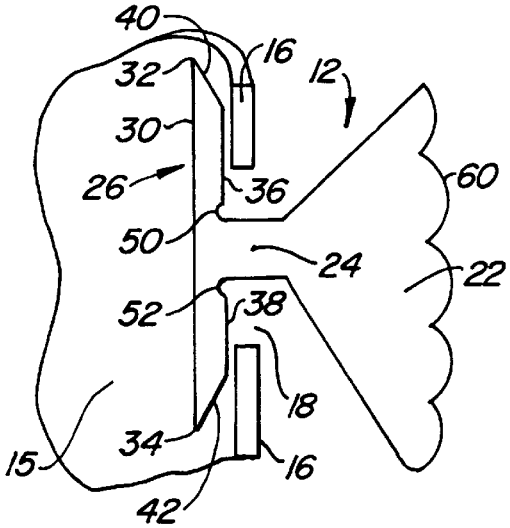
FIG. 13 is a partial side elevational view of one embodiment of the wing member being releasably secured within the back of a torso of the guardian angel doll.
Figure 14:
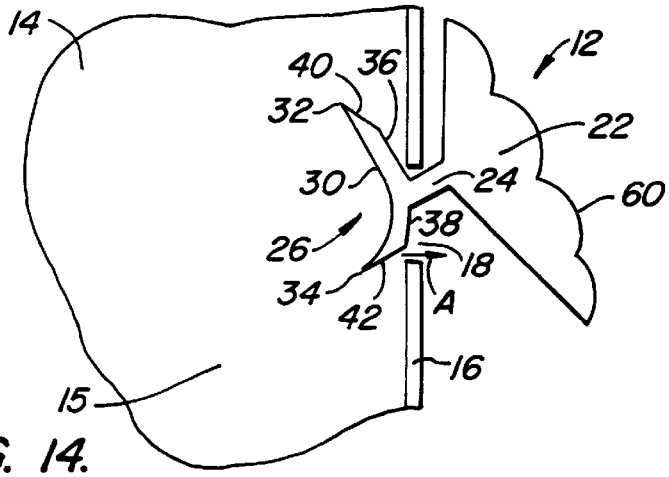
FIG. 14 is a partial side elevational view of the embodiment of the wing member of FIG. 8 illustrating diminishing the distance between two extreme parts of the wing lug as a subsequent step for inserting the wing lug through one of the opening in the back of the torso of a guardian angel doll for removably securing the wing member thereto.

As indicated, the wings 12—12 have various preferred embodiments, any of which would be suitable for the present invention. In the preferred embodiment of FIGS. 3, 8, 14 and 15, each wing 12 has a wing structure 22, a wing base 24 secured to the wing structure 22, and a wing lug, generally illustrated as 26, secured to the wing base 24. The wing structure 22 terminates in a plurality of arcuate wing edges 60. The wing lug 26 has a base surface 30 terminating in base extremity points 32 and 34. The wing lug 26 also is formed with a pair of upper lug surfaces 36 and 38 (which are generally parallel to base surface 30) and a pair of beveled (or sloping) lug ends 40 and 42. The base surface 30 of the wing lug 26 has a length that is greater or longer than the slot length L and a width 90 (see FIG. 3A) that is less than the slot width W. The length of the wing base 24 is less than the slot length L to a desirable degree such that the wings 12—12 (more specifically the wing lug 26) may be easily removed from or inserted into the slots 18—18. In another embodiment of the wings 12—12 as depicted in FIGS. 9–13, each wing lug 26 is formed with a pair of arcuate recesses 50 and 52 respectively formed in each wing lug 26 between surfaces 36 and 38 respectively and the wing base 24. In the preferred embodiment of the wing 12 depicted in FIG. 7, the base surface 30 is an arcuate or convexed base surface terminating in base extremity points 32 and 34 which also define respectively extremity points for upper lug surfaces 36 and 38 which are not parallel to the arcuate base surface 30; thus the beveled lug ends 32 and 34 have been removed in this embodiment. As best shown in FIG. 12, arcuate recess 50 (or arcuate recess 52) provide an indentation or trough for the upper (or lower) inside width edges of the opening 18 to lodge and to facilitate the insertion and/or removal of the wing lug 26 into and/or from the slot 18. As best shown in FIGS. 12 and 14, the wing lug 26 (as well as the wings 12—12) in general may be manufactured of a suitable flexible material (e.g. polyethylene, polypropylene, rubber, etc.) such that when the wing lug 26 is either being removed from or inserted into and through a slot 18 (or opening 18), the wing lug 26 is capable of bending or flexing to decrease the straight line distance between the base extremity points 32 and 34 for assisting in the removal or insertion of the wing lug 26 from or into the slot or opening 18.

Continuing to refer in detail now to the drawings for operation of the invention, any of the wing 12 embodiments are grasped and held in close proximity to the opening 18. The grasped wing 12 is angulated and one of the ends (e.g. bevelled end 40) of the wing lug 26 is inserted through the opening 18 as shown in FIG. 11. Subsequently, the other end (e.g. bevelled end 42) is bent forward to diminish the straight line distance between the bevelled ends 40 and 42 (as best shown in FIGS. 12 and 14), and the bent wing lug 26 is pushed forward until an extremity point (e.g. extremity point 34) is essentially in the back cavity or cavity 15. The bent end (e.g. bevelled end 42) is thereafter released to posture the wing 12 with respect to the back 16 (and the doll 10 in general) as best shown in FIGS. 1, 2, 4, 5, 13 and 15. The other wing 12 may be similarly installed through the other opening 18.

Figure 15:
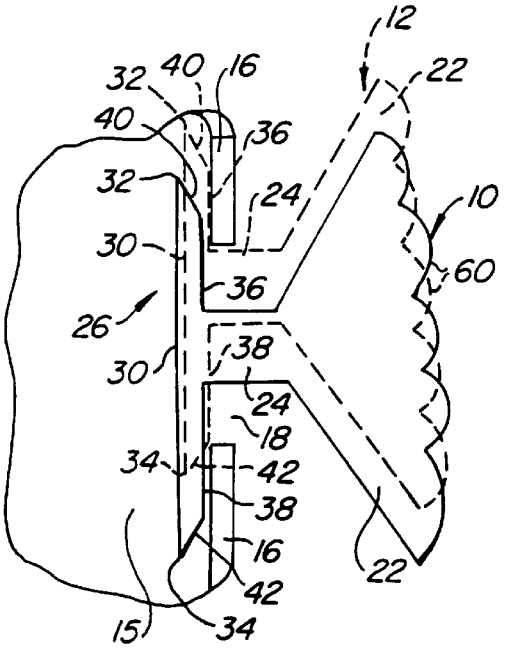
FIG. 15 is a partial side elevational view of the wing member of another embodiment of the wing member being releasably secured within the back of a torso of the guardian angel doll.

In removing a wing 12, the wing 12 is grasped and moved in a desired direction (e.g. upwardly as shown in the dotted line representation in FIG. 15) until one of the bevelled ends (e.g. bevelled end 42) is in contact with an edge (e.g. a lower edge as shown in FIG. 15) of the opening 18. The wing 12, more specifically the wing lug 26, is angulated with force in a desired direction (e.g. angulated upwardly as shown in FIGS. 12 and 14) to bend the wing lug 26 (more specifically to bend a bevelled end (e.g. end 42)) such that the bevelled end (e.g. bevelled end 42) in contact with an edge (e.g. a lower edge as shown in FIG. 15) may pop-out or spring-out of the opening 18 in direction of the arrow A in FIGS. 12 and 14. The other end (e.g. bevelled end 40 in FIGS. 12 and 14) may be subsequently easily removed from and through the opening 18.

Figure 17:
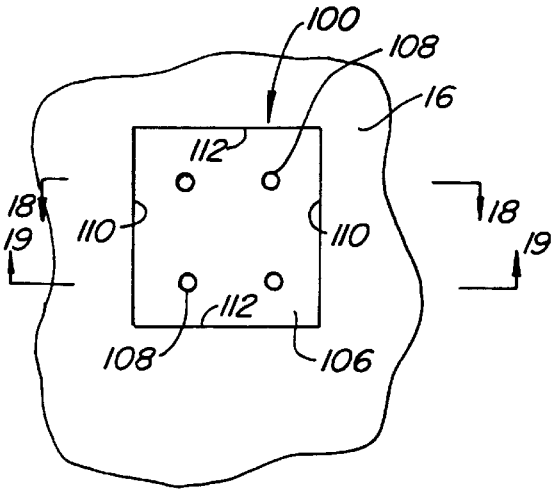
FIG. 17 is a top plan view of the back of a doll having a recess wherein the wing support member lodges.
Figure 18:
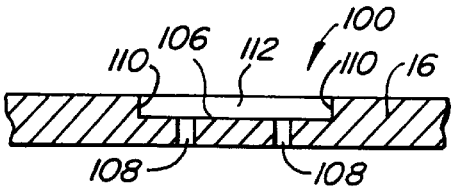
FIG. 18 is a vertical sectional view taken in direction of the arrows and along the plane of line 18—18 in FIG. 17.
Figure 19:
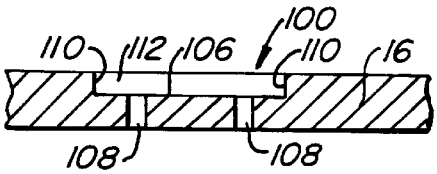
FIG. 19 is a vertical sectional view taken in direction of the arrows and along the plane of line 19—19 in FIG. 18.
Figure 20:
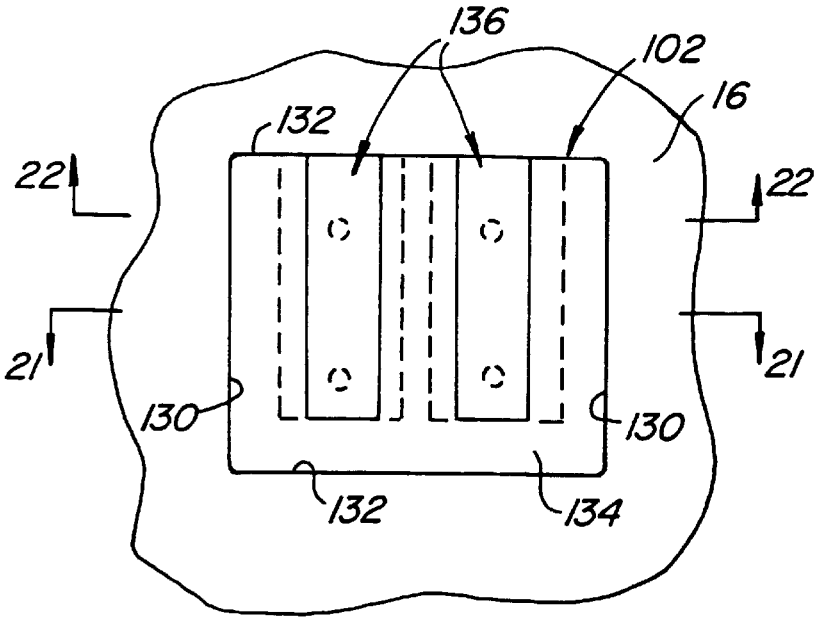
FIG. 20 is a top plan view of the back of a doll with the wing support member lodged in the recess.
Figure 21:
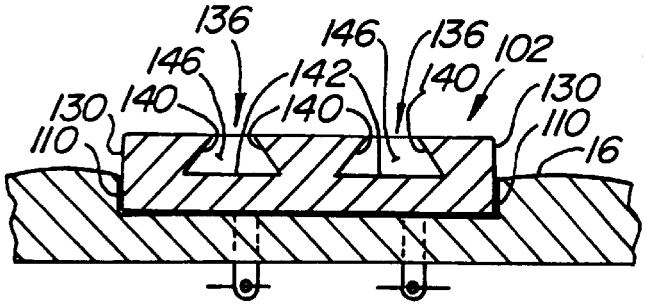
FIG. 21 is a vertical sectional view taken in direction of the arrows and along the plane of line 21—21 in FIG. 20.
Figure 22:
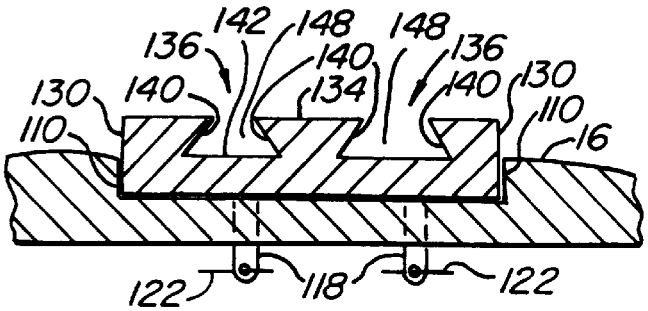
FIG. 22 is a vertical sectional view taken in direction of the arrows and along the plane of line 22—22 in FIG. 20.
Figure 23:
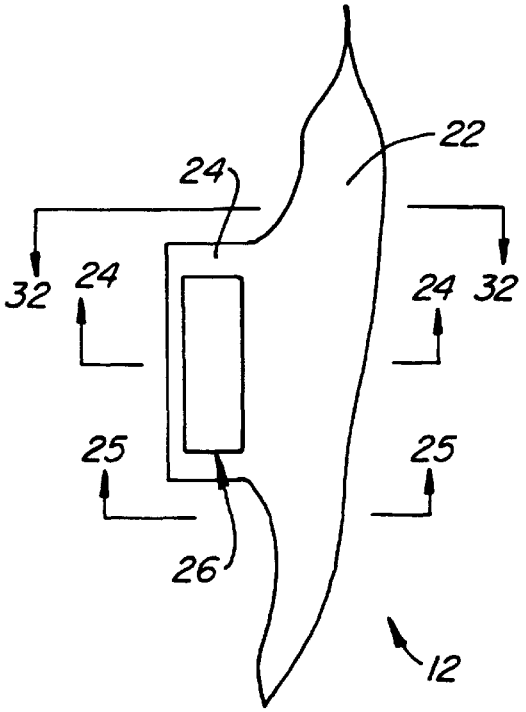
FIG. 23 is a partial top plan view of a wing illustrating the wing lug for releasably engaging the wing support member.

Referring in detail now to FIGS. 17–32 for another embodiment of the present invention, there is seen the back 16 (see FIGS. 17–19) having a recess, generally illustrated as 100, wherein lodges (as best shown in FIGS. 20 and 21) a wing support member (see FIGS. 27–30), generally illustrated as 102. The recess 100 includes a bottom 106 formed with at least one bore or opening 108 allowing the recess 100 to communicate with the cavity 15 of the torso 14 of the doll 10. The recess 100 also includes a pair of sides 110—110 and a pair of ends 112—112. As shown in FIGS. 17–19, the recess 100 is generally rectangular in shape.

The wing support member 102 is dimensioned to seat and lodge within the recess 100 as shown in FIGS. 20 and 21. The wing support member 102 (see FIGS. 27–30) comprises a bottom 116 whereto at least one peg or dowel 118 is integrally connected to form a depending relationship therewith. Each dowel 118 includes an aperture 120 where-through a pin 122 (see FIG. 26) passes to affix the wing support member 102 (and any wing 12 removably mounted thereto) within the recess 100 and to the back 16 of the torso 14 of the doll 10. The wing support member 102 also includes a pair of sides 130—130, a pair of ends 132—132, and a top 134 wherein at least one channel or groove, generally illustrated as 136, is formed. Each of the channels or grooves 136—136 is generally trapezoidal in vertical cross section and is defined by a pair of sloping channel sides 140—140 that terminate in a floor 142. The channels or grooves 136 are each also defined by an end 146 and an opening 148 opposed to the end 146. Opening 148 is for receiving the wing lug 26. Stated alternatively, wing lug 26 passes through opening 148 to slidably lodge within the channel or groove 136.

Figure 24:
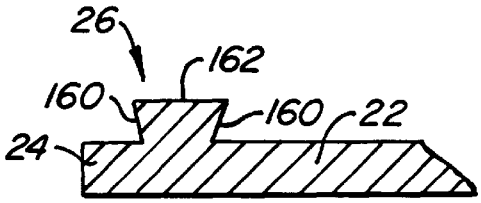
FIG. 24 is a vertical sectional view taken in direction of the arrows and along the plane of line 24—24 in FIG. 23.
Figure 25:
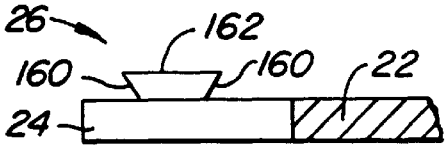
FIG. 25 is a vertical sectional view taken in direction of the arrows and along the plane of line 25—25 in FIG. 23.
Figure 26:
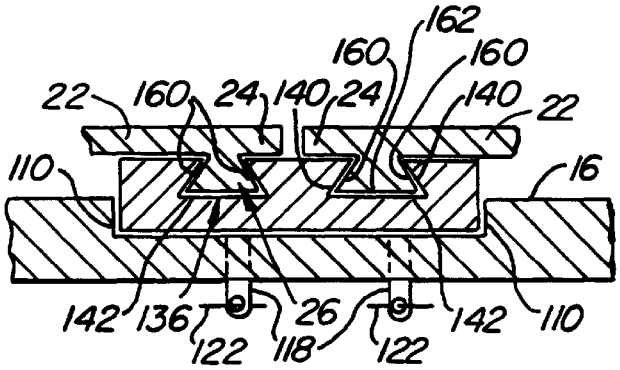
FIG. 26 is a vertical sectional view showing the wing support member lodged in the recess in the back of a doll and further partially showing a pair of wing lugs removably engaged within a pair of channels of the wing support member to releasably mount a pair of wings to the back of the doll.
Figure 27:
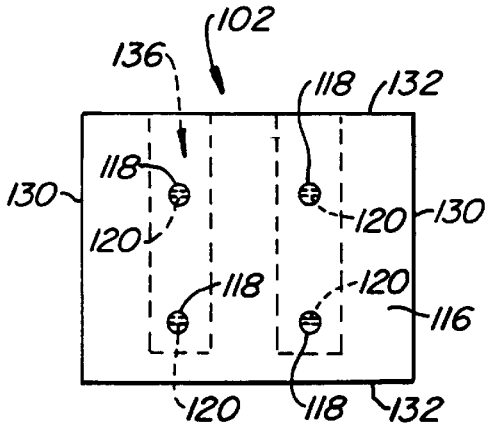
FIG. 27 is a bottom plan view of the wing support member showing the pegs or dowels which are for passing through apertures in the recess within the back of a doll.
Figure 28:
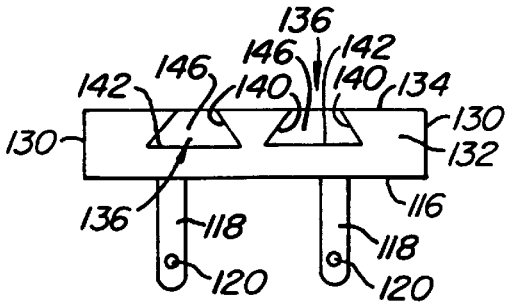
FIG. 28 is a side elevational view of the wing support member.
Figure 29:
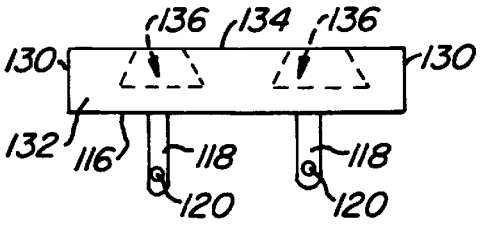
FIG. 29 is another side elevational view of the wing support member, opposite the side elevational view in FIG. 28.
Figure 30:
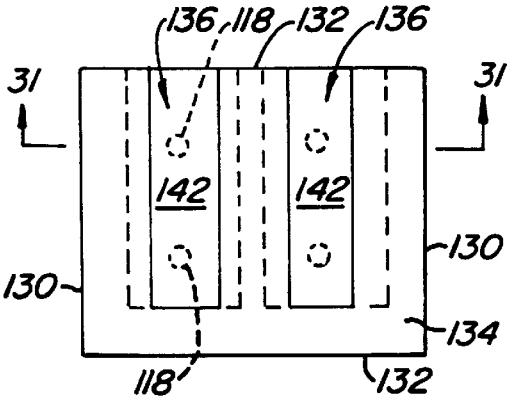
FIG. 30 is a top plan view of the wing support member.
Figure 31:
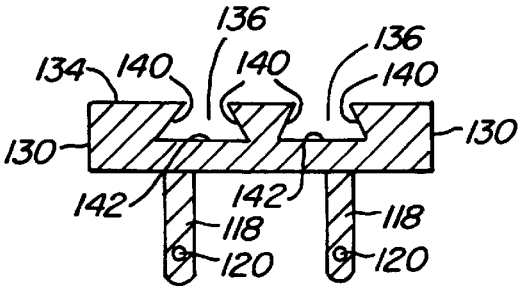
FIG. 31 is a vertical sectional view taken in direction of the arrows and along the plane of line 31—31 in FIG. 30.
Figure 32:
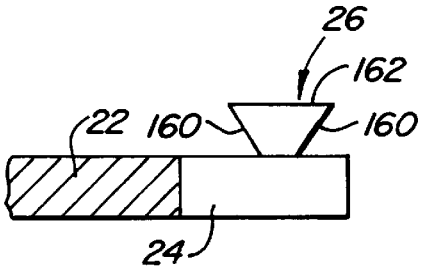
FIG. 32 is a vertical sectional view taken in direction of the arrows and along the plane of line 32—32 in FIG. 23.

As best shown in FIGS. 24, 25 and 32, the wing lug 26 is generally trapezoidal in vertical cross section and is dimensioned to pass through opening 148 and removably lodge within the channel or groove 136. Each wing lug 26 for this embodiment of the present invention includes a pair of sloping lug sides 160—160 and a base 162. When wing lug 26 passes through opening 148 after being longitudinally aligned therewith and lodges in the channel or grove 136 in order to removably secure a wing 12 to the wing support member 102 (and consequently to the back 16 of the torso 14 of the doll 10), the sloping lug sides 160—160 (see FIG. 26) respectively essentially slidably mate and/or make contact with the sloping channel sides 140—140, the base 162 of the wing lug 26 essentially slidably mates and/or make contact with the floor 142 of the channel or groove 136, and the end 146 of the channel or groove 136 prevents the wing lug 26 from sliding all the way through the channel or groove 136, causing the wing 12 to fall off the back 16 of the torso 14 of the doll 10. The end 146 provides a support for the wing lug 26 when the doll 10 is held upright. To remove the wing 12 from the back 16 of the doll 10, the wing 12 is grasped and the wing structure 22 is moved such that the wing lug 26 is slidably moved towards the opening 148 of the channel or groove 136 (and towards the head of the doll 10). The wing structure 22 is continually moved until the wing lug 26 is released from within the channel or groove 136.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A guardian angel doll comprising a doll body having a structure defining a back and at least one torso cavity, said back having a recess with a recess bottom including at least one opening communicating with said torso cavity;

a wing support member having at least one channel and at least one dowel passing through said opening and extending into said torso cavity, said dowel having a dowel aperture for receiving a pin member;

at least one wing member having a wing structure, a wing base secured to said wing structure and a wing lug secured to said wing base and removably lodged within said channel for removably mounting said wing member to said doll body.

2. The guardian angel doll of claim 1 wherein said channel is generally trapezoidal in vertical cross section and is defined by a channel opening, a channel end, and a pair of sloping channel sides terminating in said channel end.

3. The guardian angel doll of claim 2 wherein said wing lug is generally trapezoidal in vertical cross section.

4. The guardian angel doll of claim 3 additionally comprising a pin slidably passing through said dowel aperture.

5. A guardian angel doll comprising a back having a recess with a recess bottom including at least one opening;

a wing support member having at least one channel and at least one dowel passing through said opening;

said dowel having a dowel aperture for receiving a pin member;

at least one wing member having a wing structure;

a wing base secured to said wing structure; and a wing lug secured to said wing base and removably lodged within said channel for removably mounting said wing member to said wing support member.

6. The guardian angel doll of claim 5 wherein said channel is generally trapezoidal in vertical cross section and is defined by a channel opening, a channel end, and a pair of sloping channel sides terminating in said channel end.

7. The guardian angel doll of claim 6 wherein said wing lug is generally trapezoidal in vertical cross section.

8. The guardian angel doll of claim 7 additionally comprising a pin slidably passing through said dowel aperture.

9. The guardian angel doll of claim 5 wherein said wing lug is generally trapezoidal in vertical cross section.

10. The guardian doll of claim 5 additionally comprising a pin slidably passing through said dowel aperture.

* * * * *